US005234576A

United States Patent [19]

Haag et al.

[11] Patent Number: 5,234,576

[45] Date of Patent: Aug. 10, 1993

[54] ISO-OLEFIN PRODUCTION

[75] Inventors: Werner O. Haag; Mohsen N. Harandi, both of Lawrenceville; Hartley Owen, Belle Mead, all of N.J.

[73] Assignee: Mobil Oil Corporation, Fairfax, Va.

[21] Appl. No.: 738,371

[22] Filed: Jul. 31, 1991

[51] Int. Cl.[5] ..... C10G 57/00; C10G 63/04

[52] U.S. Cl. ..... 208/70; 208/106; 208/120; 208/134

[58] Field of Search ..... 208/67, 69, 70, 106, 208/120, 120 MC, 134

[56] References Cited

U.S. PATENT DOCUMENTS

| | | | |
|---|---|---|---|
| 4,749,819 | 6/1988 | Hamilton, Jr. | 585/329 |
| 4,753,720 | 6/1988 | Morrison | 208/135 |
| 4,892,643 | 1/1990 | Herbst et al. | 208/70 |
| 4,969,987 | 11/1990 | Le et al. | 208/67 |

*Primary Examiner*—Theodore Morris
*Assistant Examiner*—Walter D. Griffin
*Attorney, Agent, or Firm*—Alexander J. McKillop; Malcolm D. Keen; Marina V. Schneller

[57] ABSTRACT

The present invention discloses a process for increasing the selectivity of the production of isobutylene in an admixture of $C_4$ olefins, in a process comprising producing isobutylene, with high selectivity, comprising catalytically producing a first composition comprising at least one $C_4$ olefin selected from the group consisting of 1-butene, cis-2-butene, trans-2-butene, admixtures thereof and 2-methylpropene admixed with at least one of said 1-butene, cis-2-butene, and trans-2-butene, by passing paraffin containing feed, which feed is free of aromatics, and in which the paraffin contains 5 to 20 carbon atoms, in the vapor phase, over a first catalyst composition, wherein the catalyst comprises ZSM-5 or ZSM-12, and increasing the isobutylene content of the first composition by producing a second composition, by contacting the first composition with a second catalyst composition comprising ZSM-23 under conditions in which the second composition is in the vapor phase, while maintaining the total $C_4$ olefin content of the second composition substantially identical to the total $C_4$ olefin content of the first composition.

22 Claims, 1 Drawing Sheet

ISO-OLEFIN PRODUCTION

BACKGROUND OF THE INVENTION

The four $C_4$ mono-olefins, 1-butene, cis-2-butene, trans-2-butene and 2-methylpropene are collectively called butylenes. The term isobutylene is by established usage interchangeable with the nomenclature 2-methylpropene, while the other three isomers are n-butenes. Often they are treated collectively because the four mono-olefins are obtained as mixtures, from natural gas and from petroleum refinery processes.

Isobutylene is a desirable reactant for the production of alkylate, an oligomer of petroleum refinery $C_3$–$C_4$ off gases, which includes high octane gasoline components, and for the production of methyl-t-butyl ether, when isobutylene is reacted with methanol. In a similar manner, isoamylene can be converted to t-amyl ether. A conventional process for separation of isobutylene from the other three components involves sulfuric acid extraction or selective adsorption, as the isomers cannot be separated by simple extraction. Acid extraction is cumbersome and includes as an undesirable aspect the oligomerization of the components themselves.

SUMMARY OF THE INVENTION

It is an object of the invention to produce $C_4$ and $C_4$+ olefins and to convert said olefins to iso-olefins.

It is an object of the invention to produce a mixture of the $C_4$ mono-olefins and to convert the n-butene(s) therein to isobutylene. Accordingly, an object of the process is to produce isobutylene with high selectivity.

It is another object of the invention to produce $C_5$ normal olefins and to convert said $C_5$ olefin to isoamylene.

The process of the invention comprises catalytic production of the $C_4$ olefin mixture, including 1-butene, cis-2-butene, trans-2-butene and 2-methylpropene, in the gaseous phase, and contact of that mixture with a catalyst which will convert at least one of the members selected from the group consisting of 1-butene, cis-2-butene, and trans-2-butene to isobutylene product, essentially free of oligomers of any of the $C_4$ monoolefins.

DETAILED DESCRIPTION OF THE INVENTION

Figure 1:
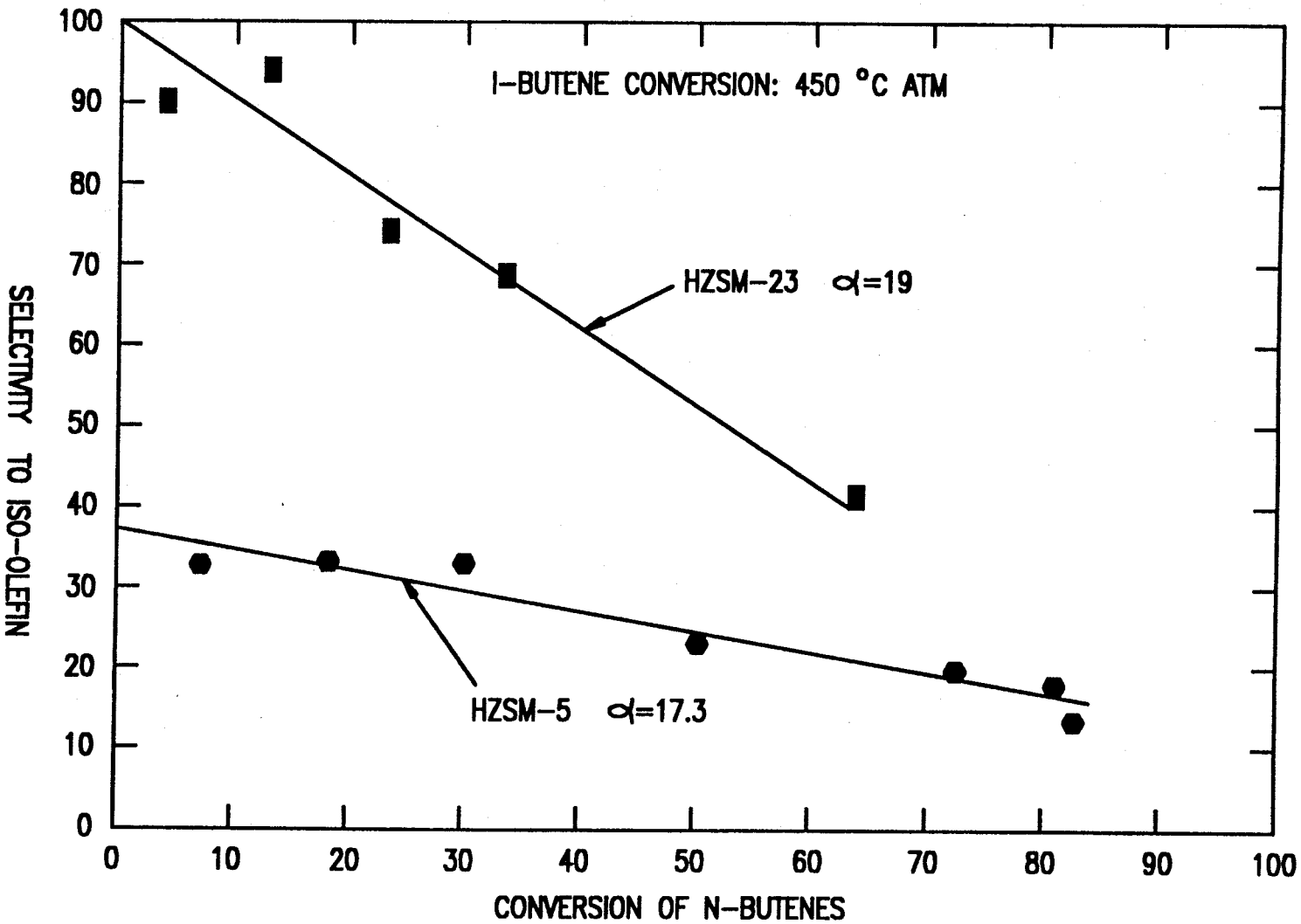
FIG. 1 is a graph of the plot of the selectivity of the production to iso-olefin vs. conversion of n-butenes. The drawing illustrates the effect of catalyst on isobutene selectivity, of 1-butene conversion at 450° C. and one atmosphere.

The process of the invention comprises catalytic production of a $C_4$ or a $C_4$+ olefin mixture, including 1-butene, cis-2-butene, trans-2-butene and 2-methylpropene, in the gaseous phase, and contact of that mixture with a catalyst which will convert at least one of the members selected from the group consisting of 1-butene, cis-2-butene, and trans-2-butene to isobutylene and/or isoamylene product, essentially free of oligomers of any of the $C_4$ monoolefins under isomerization conditions.

Catalytic production of olefin(s), in accordance with the invention can yield $C_4$ olefin(s) or $C_4$+ olefin(s), for example $C_5$ olefin(s) such as amylene in the vapor phase. Catalytic production of the $C_4$ olefin mixture, including 1-butene, cis-2-butene, trans-2-butene and 2-methylpropene, is undertaken in the gaseous phase. The reactant for the catalytic production of the $C_4$ olefin mixture, comprises an aliphatic feed which contains aliphatics having five to thirty carbon atoms. The aliphatics can be acyclic, straight or branched chain, or cyclic, either of which can be saturated or unsaturated, and include alkanes, alkenes, cycloalkanes, cycloalkenes; furthermore, the cycloalkanes and the cycloalkenes may be substituted or unsubstituted by alkyls or alkenyl groups. The aliphatic source may be a Udex raffinate, virgin distillate boiling below 650° F., light distillate and/or a naphtha. Typical naphtha feedstock materials for selective cracking are produced in petroleum refineries by distillation of crude oil. Typical straight run naphtha fresh feedstock usually contains about 20 to 50 wt % $C_7$–$C_{12}$ normal and branched alkanes, about 20 to 50 % C7+ cycloaliphatic (i.e. naphthene) hydrocarbons, and 1 to 40% (preferably less than 20%) aromatics. The $C_7$–$C_{12}$ hydrocarbons have a normal boiling range of about 65° to 175° C. The process can utilize various feedstocks such d as cracked FCC naphtha, hydrocracked naphtha, coker naphtha, visbreaker naphtha and reformer extraction (Udex) raffinate, including mixtures thereof.

The catalyst, for the catalytic production of the $C_4$ and $C_4$+olefin(s), comprises a medium and/or large pore size (5+ A) zeolite, supported or unsupported on a matrix. The medium pore size zeolites are shape selective, having a silica-to-alumina ratio of at least 12, a constraint index of 1 to 12 and acid cracking activity (alpha value) of about 1 to 15 based on total catalyst weight. When Alpha Value is examined, it is noted that the Alpha Value is an approximate indication of the catalytic cracking activity of the catalyst compared to a standard catalyst and it gives the relative rate constant (rate of normal hexane conversion per volume of catalyst per unit time). The activity of the standard catalyst, a high activity silica-alumina cracking catalyst with a Rate Constant=0.016 $sec^{-1}$ is taken as an Alpha of 1. The Alpha Test is described in U.S. Pat. No. 3,354,078; in the *Journal of Catalysis*, Vol. 4, p. 527 (1965); Vol. 6, p. 278 (1966); and Vol. 61, p. 395 (1980), each incorporated herein by reference as to that description. The experimental conditions of the test used herein include a constant temperature of 538° C. and a variable flow rate as described in detail in the *Journal of Catalysis*, vol. 61, p. 395.

Representative of the medium pore shape selective zeolites ZSM-5, ZSM-11, ZSM-12, ZSM-48, MCM-22 and mixtures thereof with similarly structured catalytic materials. Preferably, the zeolite used to produce the olefin(s) is ZSM-5 or ZSM-12. The zeolite ZSM-5 is described in U.S. Pat. No. 3,702,886 which is relied upon and incorporated by reference herein. The zeolite ZSM-12 is more particularly described in U.S. Pat. No. 3,832,449, which is relied upon and the entire contents thereof are incorporated by reference herein. The cracking of naphtha in the presence of ZSM-5 and ZSM-12 is the subject of allowed U.S. patent application Ser. No. 442,806, filed Nov. 29, 1989, U.S. Pat. No. 4,969,987 which is relied upon and incorporated by reference herein.

The catalyst may be in the form of a powder, spheres, beads or extrudates. Supports for the medium pore size zeolites are described below.

The medium pore size zeolite may be used in conjunction with or in admixture with larger pore size zeolites, with pore sizes of at least 7A. Such larger pore size zeolites include zeolites X and Y, dealuminated Y, ultrastable Y, zeolite beta, zeolite L, and the like.

Catalytic production of the $C_4$ olefin(s) is undertaken by passing the aliphatic feed, preferably containing high concentrations of naphthenes, over the catalyst in the vapor phase. Catalyst contact with the feed can be undertaken in a fixed bed, moving bed or fluidized bed. The physical conditions of the vapor phase catalysis for aliphatic(s) conversion to olefin(s) includes a temperature within the range of from about 850° to about 1150° F., preferably from about 1000° to about 1100° F. The WHSV is from about 0.5 to about 20, preferably from about 2 to about 10. The catalyst contact time can range from about 0.5 to about 10 seconds, preferably from about 1 to about 5 seconds. The operating pressure is 0–150 psig, preferably 10–50 psig.

The exact distribution and yield of $C_4$s will depend on the operating severity. The $C_4$ fraction may be separated from $C_3$ and $C_5$ hydrocarbons, which may also be produced, by conventional distillation. However this separation is not essential and is not necessarily preferred.

The catalytically produced $C_4$ olefin mixture is contacted with ZSM-23, or zeolites with similar structure, ZSM-22, ZSM-34, ZSM-35 and ZSM-48, under isomerization conditions, to increase the isobutylene content of the composition, and to decrease the content of the $C_4$s other than isobutylene, while maintaining the total $C_4$ isomers substantially constant, substantially without oligomerization thereof. Accordingly, the product of the process of the invention is substantially free of oligomerization products of any one of the $C_4$ mono-olefins. The catalytic conversion of the $C_4$ mono-olefin mixture is undertaken in the vapor phase.

ZSM-22, is more particularly described in U.S. Pat. No. 4,556,477, the entire contents of which are incorporated herein by reference.

ZSM-23 is more particularly described in U.S. Pat. No. 4,076,842, the entire contents of which are incorporated herein by reference.

ZSM-34 is more particularly described in U.S. Pat. No. 4,086,186, the entire contents of which are incorporated herein by reference.

ZSM-35 is more particularly described in U.S. Pat. No. 4,016,245, the entire contents of which are incorporated herein by reference.

ZSM-48 is more particularly described in U.S. Pat. No. 4,375,573, the entire contents of which are incorporated herein by reference.

As indicated above the zeolites of the process may be unsupported or supported on a matrix or may be in the form of a powder, spheres, beads or extrudates. Supports for the zeolites or matrix components include the following:

| matrix component | particle density (gm/cm$^3$) |
|---|---|
| alumina | 3.9–4.0 |
| silica | 2.2–2.6 |
| magnesia | 3.6 |
| beryllia | 3.0 |
| barium oxide | 5.7 |
| zirconia | 5.6–5.9 |
| titania | 4.3–4.9 |

Combinations of two or more of these and/or other suitable porous matrix components, e.g., silica-alumina, silica-magnesia, silica-thoria, silica-alumina-zirconia, etc., can be employed for a still wider spectrum of density values from which one may select a specific predetermined value as desired.

Isomerization of the olefin mixture can be undertaken at a temperature within the range of from about 700° to about 1150° F., preferably from about 750° to about 1050° F., more preferably 700 to 950. and most preferably 700 to 900° F. The WHSV is from about 5 to about 200 preferably about 15 to 50. The catalyst contact time can range from about 0.01 to about 10 seconds, preferably from about 0.03 to about 5 seconds. The operating pressure is 0–150 psig, preferably 10–50 psig. The cracking catalyst and the isomerization catalyst composition can be in admixture.

The process of the invention may be undertaken in a fixed bed, moving bed or fluidized bed. Preferably, $C_4$ production and isomerization thereof is undertaken under fluidized bed conditions, under operating conditions described above. In a preferred embodiment, the two catalyst components are mixed. Alternatively, the process may be undertaken in a fixed bed system. Thus the catalyst beds including the cracking catalyst component and the ZSM-23 may be in different units or alternatively in sequential beds in a cascade operation. If a fixed bed operation is employed, preferably, it is operated as a cascade operation in which the paraffin feed is converted to $C_4$ with the cracking catalyst component and then with the isomerization catalyst comprising the ZSM-23.

Although various amounts of the two sets of catalysts can be used, the isomerization catalyst inventory is preferably less than 5% of the total catalyst inventory; it is preferred to operate at an isomerization catalyst make up rate of greater than zero (0) and less than 0.3 weight percent of the total catalyst inventory per day.

The selective cracking conditions include total pressure up to about 500 kPa and reaction temperature of about 850° F. to 1150° F., preferably at pressure less than 175 kPa. Cracking reaction severity can be maintained by employing a weight hourly space velocity of about 1 to 20 (WHSV based on active catalyst solids); and contact time less than 10 seconds, usually about 1–2 seconds. The conversion of n-butene to iso-butene over ZSM-23 at atmospheric pressure, high WHSV, and about 1000° F. occurs with no significant oligomerization to heavier molecules. The ZSM-23 isomerization of n-butene(s) is favored by low reactant partial pressure and high operating temperature in a cracker process. In such an embodiment, preferably the ZSM-23 containing catalyst is added to the cracker in short time intervals or continuously. The ZSM-23 catalyst can be added to the cracker unit at any location in the riser, transfer line, or reactor cyclones.

EXAMPLES

In Table 1, the results of passing 1-butene (152 Torr); over HZSM-23 (alpha=19) (.06013 g m s) under the conditions set forth are set forth

TABLE I

| Press (Psig) | 3 | 5 | 8 |
|---|---|---|---|
| Temp (°C.) | 500 | 501 | 501 |
| Flow (CC/Min) | 100 | 150 | 200 |
| WHSV | — | — | — |
| WEIGHT PERCENT IN PRODUCT STREAM | | | |
| C10 | 0.238 | 0.177 | 0.146 |
| C20 | 0.031 | 0.022 | 0.018 |
| C2= | 0.281 | 0.199 | 0.158 |
| C30 | 0.014 | 0.008 | 0.006 |

TABLE I-continued

| | | | |
|---|---|---|---|
| C3= | 1.351 | 0.971 | 0.775 |
| I-C40 | 0.158 | 0.110 | 0.086 |
| N-C40 | 0.561 | 0.461 | 0.408 |
| 1-C4= | 16.516 | 17.915 | 19.113 |
| I-C4= | 34.474 | 30.874 | 27.636 |
| TR-2-C4= | 26.935 | 28.726 | 30.140 |
| CIS-2-C4= | 18.518 | 19.904 | 21.043 |
| N-C50 | 0.000 | 0.000 | 0.000 |
| 3M-1-C4= | 0.000 | 0.000 | 0.000 |
| 1-C5= | 0.000 | 0.000 | 0.000 |
| TR-2-C5= | 0.119 | 0.076 | 0.057 |
| CIS-2-C5= | 0.044 | 0.025 | 0.000 |
| TERT-C5= | 0.654 | 0.476 | 0.384 |
| C6= | 0.079 | 0.055 | 0.029 |
| C7+ | 0.026 | 0.000 | 0.000 |
| C1-C5 PARFNS | 1.002 | 0.778 | 0.664 |
| C2= | 0.281 | 0.199 | 0.158 |
| C3= | 1.351 | 0.971 | 0.775 |
| C4= | 96.443 | 97.419 | 97.932 |
| C5= | 0.817 | 0.577 | 0.441 |
| C6= | 0.079 | 0.055 | 0.029 |
| C7+ | 0.026 | 0.000 | 0.000 |
| Conv. of N-C4= | 38.031 | 33.455 | 29.704 |
| I-C4= | 34.474 | 30.874 | 27.636 |
| Sel. to I-C4= | 90.647 | 92.285 | 93.039 |

The addition of ZSM-23 catalyst increases the presence of all iso-olefins in the reaction effluent, particularly isoamylene and isobutene.

What is claimed is:

1. A process for producing an isoolefin with high selectivity, comprising catalytically producing a first composition comprising at least one normal-olefin of at least 4 carbon atoms in a first product stream, by passing a feed in the vapor phase, over a first catalyst composition, at a temperature of 850° to 1150° F., a WHSV of 0.5 to 20 and a pressure of 0 to 150 psig, wherein the first catalyst composition comprises ZSM-5 or ZSM-12, wherein the feed comprises an aliphatic and in which the aliphatic contains 5 to 20 carbon atoms; and increasing the isoolefin content of the first composition, with substantially no oligomerization to heavier molecules, by producing a second composition, wherein said second composition is produced by contacting the normal-olefin with a second catalyst composition comprising ZSM-23, under a second set of conditions which include a temperature within the range of from about 700° F. to about 1150° F.

2. The process of claim 1, wherein said second set of conditions includes a temperature within the range of from about 700° F. to about 950° F.

3. The process of claim 1, wherein said second set of conditions includes a temperature within the range of from about 700° F. to about 900° F.

4. The process of claim 1, wherein the first product stream is contacted with said second catalyst composition.

5. The process of claim 1 wherein said normal olefin is amylene.

6. The process of claim 4, wherein said first product stream comprises $C_4$–$C_5$ olefins.

7. The process of claim 6, which includes recovering isobutylene, isoamylene or admixtures thereof.

8. The process of claim 7, wherein said second set of conditions includes a temperature within the range of from about 700° F. to about 950° F.

9. The process of claim 7, wherein said second set of conditions includes a temperature within the range of from about 700° F. to about 900° F.

10. The process of claim 1 wherein said first composition comprises amylene.

11. The process of claim 10, wherein said first composition comprises $C_4$–$C_5$ olefins.

12. The process of claim 11, which includes recovering isobutylene, isoamylene or admixtures thereof.

13. The process of claim 12, wherein said second set of conditions includes a temperature within the range of from about 700° F. to about 950° F.

14. The process of claim 13, wherein said second set of conditions includes a temperature within the range of from about 700° F. to about 900° F.

15. The process of claim 14, wherein the first catalyst and the second catalyst are admixed.

16. A process for producing isobutylene, with high selectivity, comprising catalytically producing a first composition comprising at least one $C_4$ olefin selected from the group consisting of 1-butene, cis-2-butene, trans-2-butene, admixtures thereof and 2-methylpropene admixed with at least one of said 1-butene, cis-2-butene, and trans-2-butene, by passing a feed in the vapor phase at a temperature of 850° to 1150° F., a WHSV of 0.5 to 20 and a pressure of 0 to 150 psig, over a first catalyst composition comprising a cracking catalyst, wherein the feed comprises an aliphatic, and in which the aliphatic contains 5 to 20 carbon atoms F; and increasing the isobutylene content of the first composition by producing a second composition, by contacting said at least one $C_4$ olefin with a second catalyst composition comprising ZSM-23, under a second set of conditions which include a temperature within the range of from about 700° F. to about 1150° F., with substantially no oligomerization to heavier molecules.

17. The process of claim 16, wherein said second set of conditions includes a temperature within the range of from about 700° F. to about 950° F.

18. The process of claim 16, wherein said second set of conditions includes a temperature within the range of from about 700° F. to about 900° F.

19. The process of claim 18, wherein the the second catalyst composition comprises less than 5% (by weight) of the combined cracking catalyst and second catalyst composition.

20. The process of claim 16, wherein said second set of conditions includes a temperature within the range of from about 700° F. to about 950° F.

21. The process of claim 16, wherein said second set of conditions includes a temperature within the range of from about 700° F. to about 900° F.

22. The process of claim 16, wherein the first composition is contacted with said second catalyst composition.

* * * * *